US006142078A

United States Patent [19]

Lachajewski

[11] Patent Number: 6,142,078

[45] Date of Patent: Nov. 7, 2000

[54] ADAPTIVE COLOR CONTROL SYSTEM AND METHOD FOR REGULATING INK UTILIZING A GAIN PARAMETER AND SENSITIVITY ADAPTER

[75] Inventor: Steven J. Lachajewski, Pewaukee, Wis.

[73] Assignee: Quad/Tech, Inc., Sussex, Wis.

[21] Appl. No.: 09/256,596

[22] Filed: Feb. 23, 1999

Related U.S. Application Data

[63] Continuation-in-part of application No. 09/189,655, Nov. 10, 1998.

[51] Int. Cl.[7] ..... B41F 1/54; B41F 1/66; B41F 33/00; B41L 39/00; B41L 95/56

[52] U.S. Cl. ..... 101/484; 101/211; 101/365

[58] Field of Search ..... 101/365, 366, 101/171, 174, 181, 183, 211, 206, 207, 210, 335, 349.1, 350.1, 484; 347/5, 6, 19; 364/157, 469.02, 469.03; 395/104, 109; 382/162, 167, 270

[56] References Cited

U.S. PATENT DOCUMENTS

| | | | |
|---|---|---|---|
| 3,835,777 | 9/1974 | Krygeris | 101/350 |
| 4,655,135 | 4/1987 | Brovman | 101/426 |
| 5,023,812 | 6/1991 | Pfeiffer | 364/519 |
| 5,692,485 | 12/1997 | Maki et al. | 123/684 |
| 5,714,725 | 2/1998 | Thangavelu | 187/382 |
| 5,724,259 | 3/1998 | Seymour et al. | 364/526 |
| 5,793,022 | 8/1998 | Klinck et al. | 219/483 |
| 5,812,428 | 9/1998 | Zou et al. | 364/571.02 |
| 5,822,740 | 10/1998 | Haissig et al. | 706/3 |
| 5,841,955 | 11/1998 | Wang | 395/109 |
| 5,967,050 | 10/1999 | Seymour | 101/484 |

FOREIGN PATENT DOCUMENTS

| | | |
|---|---|---|
| 4212575 | 10/1992 | Germany . |
| 403038355 | 2/1991 | Japan . |
| 404221640 | 8/1992 | Japan . |
| 404221642 | 8/1992 | Japan . |

OTHER PUBLICATIONS

Timothy J. Ross, Fuzzy Logic with Engineering Applications Copyright 1995, Chapter 5.

*Primary Examiner*—Kimberly Asher
*Attorney, Agent, or Firm*—Michael Best & Friedrich LLP

[57] ABSTRACT

An adaptive control system is intended for use in conjunction with a printing press to control the setting of an ink control device that regulates the amount of ink applied to a substrate. The control system includes a controller for calculating a new setting for the ink control device based on a measured ink color value and a target ink color value. The controller has at least one gain parameter. The control system also includes a sensitivity adapter in communication with the controller. The sensitivity adapter modifies the gain parameter in response to the sensitivity of the ink control device to a correction in setting issued by the controller. The control system operates so that a measured ink color value on the substrate converges toward a target ink color value.

20 Claims, 11 Drawing Sheets

$$
\begin{bmatrix}
.460 & .196 & .043 & .016 & .009 & .007 & .000 & .000 & .000 & \cdots & \cdots & & \\
.196 & .460 & .196 & .043 & .016 & .009 & .007 & .000 & .000 & \cdots & \cdots & & \\
.043 & .196 & .460 & .196 & .043 & .016 & .009 & .007 & .000 & \cdots & \cdots & & \\
.016 & .043 & .196 & .460 & .196 & .043 & .016 & .009 & .007 & \cdots & \cdots & & \\
.009 & .016 & .043 & .196 & .460 & .196 & .043 & .016 & .009 & .007 & \cdots & & \\
.007 & .009 & .016 & .043 & .196 & .460 & .196 & .043 & .016 & .009 & .007 & & \\
.000 & .007 & .009 & .016 & .043 & .196 & .460 & .196 & .043 & .016 & .009 & .007 & \\
.000 & .000 & .007 & .009 & .016 & .043 & .196 & .460 & .196 & .043 & .016 & .009 & .007 \\
\vdots & \vdots & & & & & & & & & & & \\
\vdots & \vdots & & & & & & & & & & & \\
\vdots & & & & & .007 & .009 & .016 & .043 & .196 & .460 & .196 & .043 \\
\vdots & & & & & .000 & .007 & .009 & .016 & .043 & .196 & .460 & .196 \\
.000 & \cdots & \cdots & & & \cdots & .000 & .007 & .009 & .016 & .043 & .196 & .460
\end{bmatrix}
$$

Fig. 11

$$M^{-1} = \begin{bmatrix} 1/.518 & -.196/.518 & -.045/.518 & 0 & 0 & 0 & . & . & . & 0 \\ -.196/.518 & 1/.518 & -.196/.518 & -.045/.518 & 0 & 0 & . & . & . & 0 \\ -.045/.518 & -.196/.518 & 1/.518 & -.196/.518 & -.045/.518 & 0 & . & . & . & 0 \\ 0 & -.045/.518 & -.196/.518 & 1/.518 & -.196/.518 & -.045/.518 & 0 & . & . & 0 \\ . & & & & . & . & & & & . \\ . & & & & . & . & & & & . \\ 0 & . & . & . & 0 & 0 & 0 & -.045/.518 & -.196/.518 & 1/.518 \end{bmatrix}$$

Fig. 12.

ADAPTIVE COLOR CONTROL SYSTEM AND METHOD FOR REGULATING INK UTILIZING A GAIN PARAMETER AND SENSITIVITY ADAPTER

RELATED APPLICATIONS

This application is a continuation-in-part of Ser. No. 09/189,655, filed Nov. 10, 1998, pending.

FIELD OF THE INVENTION

The present invention relates generally to a system and method for controlling the ink feed in a printing press in order to achieve and maintain target values of color. More particularly, the invention relates to a system and method for controlling ink feed using an adaptive control.

BACKGROUND OF THE INVENTION

A web-offset printing press operates to print a multi-color image by combining several single color images through superimposed printing on a moving substrate or web. A typical four color printing process includes black, cyan, magenta and yellow ink. The color quality of the printed image is determined by the degree to which the colors of the printed image match a desired or exemplary reference image, which is often provided or endorsed by the print customer. One way to evaluate color involves visual examination of the printed image by a trained pressman. Another way to evaluate color is to measure the optical density of a solid color bar printed on the substrate. In general terms, the actual color quality is compared to the desired quality, and the amount of ink fed to the substrate is adjusted as necessary.

In particular, the printing press includes an inking assembly for each color of ink used in the printing process. Each inking assembly includes an ink reservoir as well as a blade disposed along the outer surface of an ink fountain roller. The amount of ink supplied to the roller train of the press and ultimately to a substrate such as paper is adjusted by changing the spacing between the edge of the blade and the outer surface of the ink fountain roller. The blade is divided into a plurality of blade segments, and the position of each blade segment relative to the ink fountain roller is independently adjustable by movement of an adjusting screw, or ink key, to thereby control the amount of ink fed to a corresponding strip or zone of the substrate extending in the longitudinal direction. A typical printing press includes 24–30 ink keys which operate to control ink to an ink key zone having a dimension of approximately 1.2–2.5 inches.

Ink is also spread laterally from one ink key zone to adjacent zones on the substrate due to the movement of vibrator rollers, which oscillate in a lateral direction relative to the longitudinal direction of travel of the substrate.

In order to preset the initial positions of the ink keys, it is common for a printing press operator to visually examine printed copies or proofs of the image to be printed and to note the amount of color necessary in respective zones of the image to be printed. Based on this visual examination as well as experience with the press, ink, and type of substrate (typically paper), the operator may preset the ink keys to approximate the settings that will be required once the press is running. As an example, low-tack yellow ink has a low pigment strength and requires a greater amount of ink to produce an image with a given optical density. As another example, uncoated paper requires more ink than does coated paper to achieve an image having a given optical density.

Once the printing press is started, the rate of ink flow from the ink fountain to the web must be controlled by adjusting the ink keys for each of the ink colors. The time spent for the ink key adjustment until the desired solid ink density for each zone is achieved on press is termed makeready. Again, ink key adjustment is typically achieved based on visual examination and manual adjustment by an experienced press operator. After makeready, it is common for a press operator to continually monitor the printed output and to make appropriate ink key adjustments in order to achieve appropriate quality control of the color of the printed image. For example, if the color in a zone is too weak, the operator adjusts the corresponding ink key to allow more ink flow to that zone; if the color is too strong, the corresponding ink key is adjusted to decrease the ink flow. Also during runtime, further color adjustments may be necessary to compensate for changing press conditions, or to account for the personal preferences of the customer.

The above-described visual inspection and manual adjustment techniques used in connection with ink key presetting, makeready, and runtime are relatively inaccurate, expensive, and time-consuming. Additionally, such techniques require a high level of operator expertise.

Methods other than visual inspection of the printed image are known for monitoring color quality once the press is running. These methods typically include measuring the optical density of a printed image. Optical density of various points of a printed image can be measured by using a densitometer or scanning densitometer either off-line or on-line of the web printing process. Optical density measurements are performed by illuminating a test image with a light source and measuring the intensity of the light reflected from the image. Optical density (D) is defined as:

$$D=-\log_{10}(R)$$

where R is the reflectance, or ratio of reflected light intensity to incident light intensity.

Since substrate material is wasted until acceptable color is achieved, an accurate and quick method of determining ink key settings will minimize the required time and material costs. Especially for print jobs of short duration, start-up waste can be a major percentage of total time and materials required.

Typically, a conventional proportional-integral-derivative (PID) controller is the most widely used controller in industry. A PID controller is a control system where the control signal is a weighted sum of the current error, the summation of past errors, and the change in error since the previous sampling. The error is defined as the difference between the measured value and a target value. The weights are selected to provide the desired system performance. In particular, it may be beneficial to set one or two of the weights to zero.

The conventional PID controller was developed in the 1940's based on the classical linear time-invariant system. Theoretically, such a controller would work well in a printing application to control ink feed rate provided that the entire printing process was linear and time invariant. In other words, for example, the color density would need to be proportional to the ink key settings and the factors affecting the entire printing process would need to remain unchanged.

SUMMARY OF THE INVENTION

A conventional controller, such as a PID controller, does not work well if the controlled system is highly nonlinear or includes uncertain factors in the working environment.

Because printing, such as web offset printing, is a very complicated process, there are many known and unknown factors which affect the measured solid ink density (SID) values such that the overall system is nonlinear. Known factors affecting the SID values include the make and model of the printing press, ink and color variations, fountain solution pH values, operating temperature variations, differences in paper stock, age and speed of the press, etc. Consequently, it is not desirable to control color using a controller alone having a fixed or constant set of gain parameters because such a controller is unable to account for all the different operating conditions of the press and its environment.

The invention includes an adaptive control system for use in conjunction with a printing press to control the setting of an ink control device that regulates the amount of ink applied to a substrate so that a measured ink color value on the substrate converges toward a target ink color value. In one embodiment, the system includes a controller for calculating a new setting of the ink control device based upon a measured ink color value and a target ink color value. The controller uses at least one gain parameter. The system also includes a sensitivity adapter in communication with the controller to adaptively modify the at least one gain parameter in response to the sensitivity of the ink control device to a change in setting issued by the controller.

The invention also includes a method for controlling ink fed by an ink control device to a substrate in a printing press. In one embodiment, the method includes providing a target color value for the ink on the substrate, measuring an actual color value of the ink on the substrate, comparing the target color value to the actual color value to determine an error, calculating a sensitivity variable which represents the effectiveness of the ink control device in correcting for any error, and calculating a new position of the ink control device based upon the error and based upon the sensitivity variable so that the next measured color value converges toward the target color value.

It is a feature of the present invention to provide a method and system for accurate control of color on a printing press utilizing adaptive control which overcomes the disadvantages of conventional controllers.

It is a feature of the present invention to provide a system and method to control the ink applied to the substrate in a printing press utilizing adaptive control wherein the controller gain parameters are tuned to adjusted values in real time.

It is a feature of the present invention to accomplish such adaptive control with the use of fuzzy logic.

It is a feature of the present invention to provide an adaptive control system and method for use in conjunction with a printing press for adaptively controlling the position of an ink control device.

It is a feature of the present invention to provide a system and method to control ink fed to a substrate of a printing press to compensate for non-linearities in the operation and environment of the printing press.

It is a feature of the present invention to provide a system and method to control color in a printing press by monitoring the sensitivity of the ink keys.

It is a feature of the present invention to provide a system and method that monitors how an ink key responds to a correction in its position.

It is a feature of the present invention to provide a system and method that accomplishes adaptive control of color in a printing press using a sensitivity adapter.

It is a feature of the present invention to provide a system and method to control color in a printing press wherein the effectiveness of an ink key move is monitored.

It is a feature of the present invention to provide a system and method to control color wherein a sensitivity adapter modifies at least one controller gain parameter in real time.

It is a feature of the present invention to provide a system and method to control color wherein a control loop corrects for a preset percentage of the error in ink density.

Other features and advantages of the invention will become apparent to those of ordinary skill in the art upon review of the following detailed description and drawings.

BRIEF DESCRIPTION OF THE DRAWINGS

FIG. 3(*b*) is a side view of the inking assembly of FIG. 2, when the ink key is closed.

FIG. 11 is an example of an ink key spread matrix;

FIG. 12 is an example of an approximate inverse spread matrix;

Figure 1:
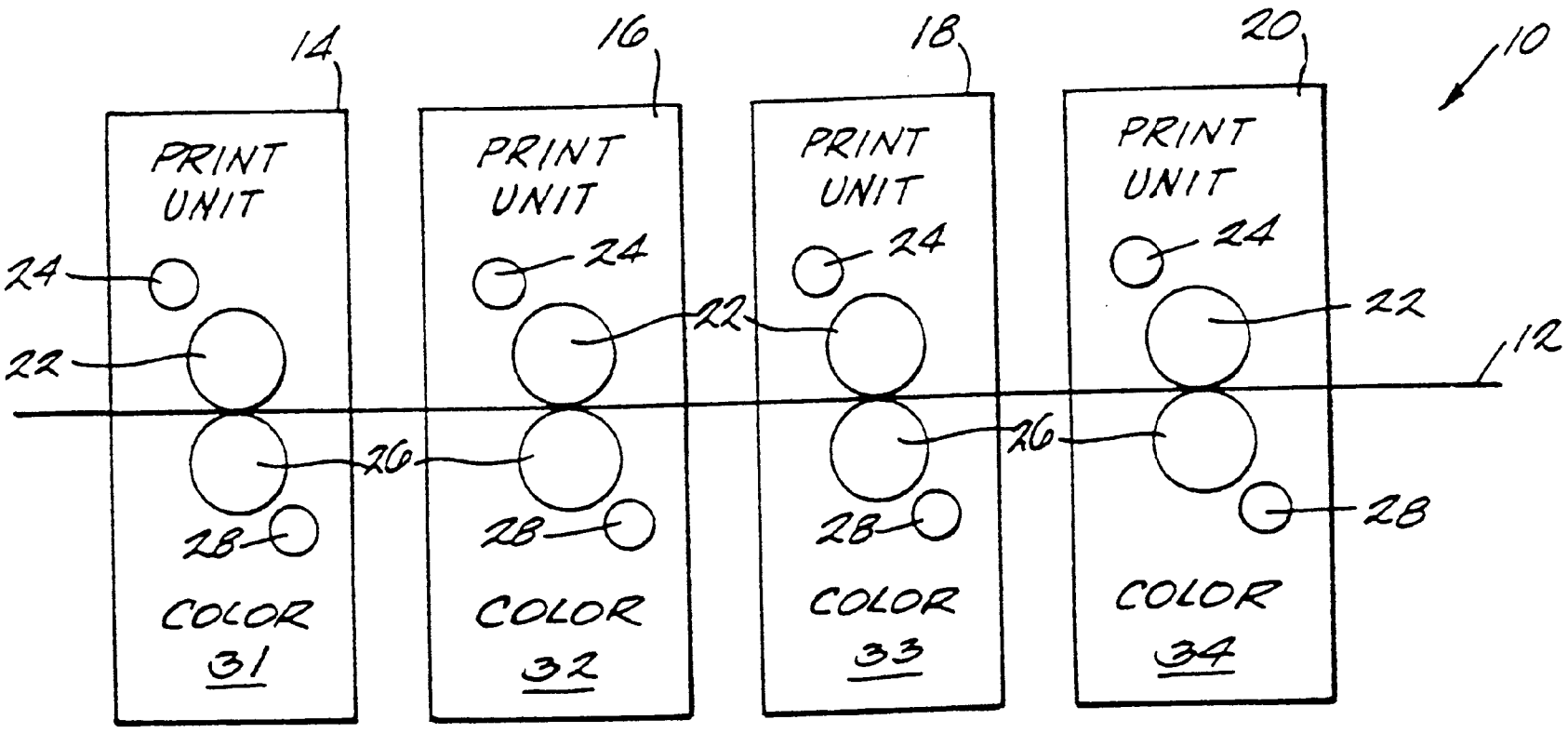
FIG. 1 is a block diagram of a web-offset printing system in accordance with the present invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

The following description of the two embodiments of the present invention specifically relates to a Harris M1000B web offset printing press using 24 ink keys as an example. It should be noted that the invention is applicable to other models of printing presses (such as sheet fed printing presses), to printing presses of other manufacturers, to printing presses having a different number of ink keys (such as 22 or 36), and to printing presses having other types of ink control or ink metering devices (such as segmented ink keys, ultrasonic ink feeding devices, ratchet assemblies, segmented blades, continuous blades, and the like).

FIG. 1 illustrates a web-offset printing system 10 for printing a multi-color image upon a moving web 12. In the preferred embodiment, four printing units 14, 16, 18, and 20 each print one color of the image upon the web 12. The location of printing units 14, 16, 18, and 20 relative to each other is determined by the printer, and may vary. Each printing unit 14, 16, 18, 20 includes a printing plate cylinder and a blanket cylinder. This type of printing is commonly referred to as web-offset printing. In particular, each printing unit includes an upper blanket cylinder 22, an upper printing plate cylinder 24, a lower blanket cylinder 26, and a lower printing plate cylinder 28 to permit printing on both sides of web 12. In printing system 10, colors 31, 32, 33, and 34 on printing units 14, 16, 18, and 20, respectively, are typically black (K), cyan (C), magenta (M), and yellow (Y). Cyan, magenta, and yellow are three subtractive primary color inks which are used to reproduce the color image. The black ink is used to sharpen features and to replace the overprints of the three primary ink colors.

Figure 2:
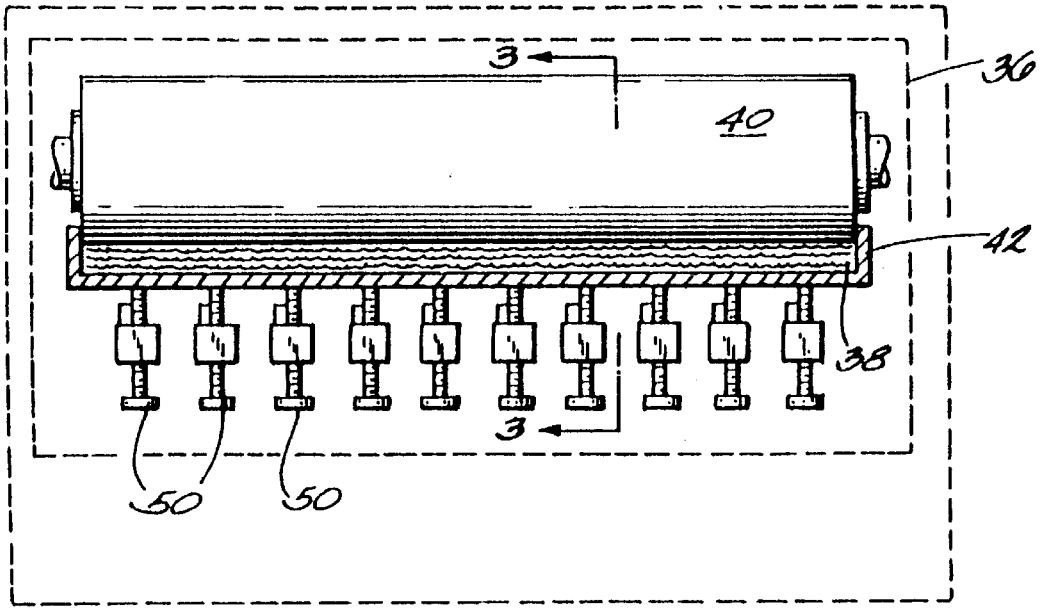
FIG. 2 is an illustration of an inking assembly including an ink fountain roller, ink reservoir, and ink keys.
Figure 3A:
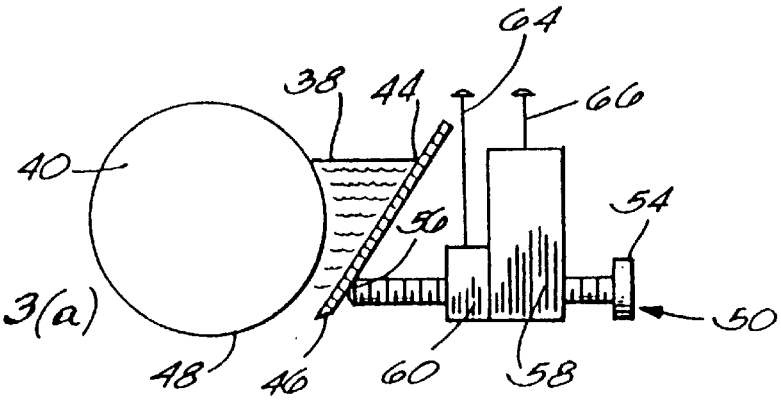
FIG. 3(*a*) is a side view of the inking assembly of FIG. 2, taken along line 3—3, when the ink key is partially open.
Figure 3B:
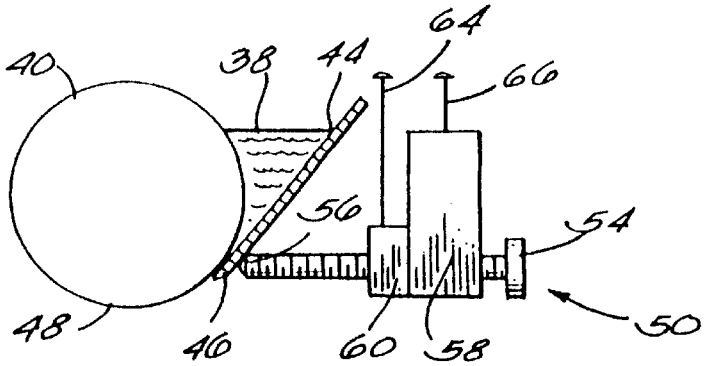

Each printing unit 14, 16, 18, and 20 includes an associated inking assembly 36 which is shown in FIG. 2. Inking assembly 36 operates to supply ink to a roller train which includes a plate cylinder and a blanket cylinder and then to the web 12. In particular, inking assembly 36 includes an ink reservoir 38 disposed adjacent an ink fountain roller 40 (also known as the ink ball) which extends laterally across the web. A blade 42 extends along the ink fountain roller 40 and is segmented so that the spacing of each segment relative to the ink fountain roller 40 can be independently adjusted to control the ink fed to a respective ink key zone on the web 12. As shown in FIGS. 3(*a*) and 3(*b*), each blade segment 44 has an edge 46 which is moved toward and away from the outer surface 48 of the ink fountain roller 40 by adjustment of an associated ink flow adjustment device 50.

More specifically, a portion of the ink fountain roller 40 forms one main wall of the ink reservoir 38. The other principal wall of the reservoir 38 is provided by the blade segments 44. Ink passes from the ink reservoir 38 through the space between the surface of the ink fountain roller 40 and the lower edge 46 of the blade segment 44, and the spacing of the blade edge 46 to the ink fountain roller 40 acts to control the thickness of the ink film provided to the outer surface 48 of ink fountain roller 40.

A plurality of the ink flow adjustment devices 50 are disposed at equally-spaced lateral locations along the inking assembly 36 to press against the blade segments 44 at those locations to establish and adjust the size of the space between the roller 40 and the blade segment 44. Each ink flow adjustment device 50 includes an ink key 54 having screw threads engaging threads in a fixed portion of the frame of the inking assembly 36. The ink key 54 has a tip portion 56 which pushes against the associated blade segment 44 to deflect it and to thereby provide locally adjustable control of the spacing and the ink feed.

The ink key 54 is driven by a bi-directional actuator motor 58 which operates to move the ink key 54 toward and away from the ink fountain roller 40. A potentiometer 60 has a movable arm mechanically connected with the ink key 54. The potentiometer 60 has a pair of outside electrical terminals and an inside electrical terminal 64 located between the outside electrical terminals. The inside terminal of the potentiometer is mechanically connected to the movable arm of the potentiometer 60. The position of the movable arm of the potentiometer 60 thus depends upon the position of the ink key 54. The potentiometer 60 is energized at its outside electrical terminals so that an electrical signal indicative of the position of the ink key is produced at the inside electrical terminal of the potentiometer. The motor 58 is responsive to a signal on line 66 to position the ink key 54 as desired.

Figure 4:
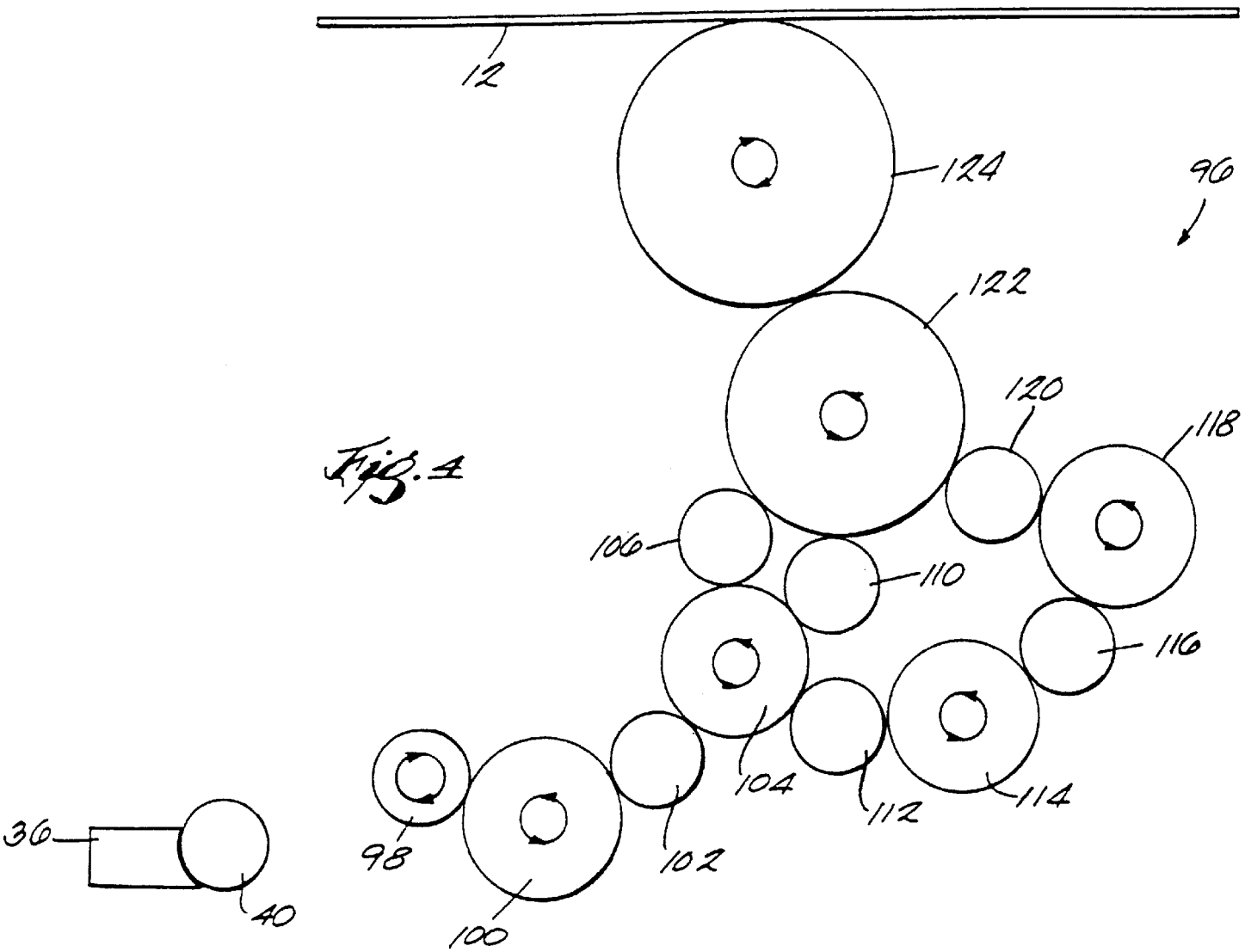
FIG. 4 is a schematic of a roller train of a lower printing unit of a Harris M1000B printing press.

FIG. 4 is an illustration of a side view of a roller train 96 of a lower printing unit of a Harris M1000B printing press. Ink is supplied from the inking assembly 36 via the ink fountain roller 40 to a ductor roller 98 which continuously moves back and forth from contact with the ink fountain roller 40 and roller 100. The amount of ink on the ink fountain roller itself is also adjustable by changing the angle that the ink fountain roller 40 rotates with each stroke. This occurs by adjusting a conventional ratchet assembly (not shown) as is known in the art. The rotation angle, along with the positions of the blade segments 44, determine the amount of ink transferred to the ductor roller 98. The relationship between the rotation angle and the amount of ink transferred to ductor roller 98 is assumed to be linear. Ink is supplied from roller 100 to the various other rollers 102–124 as shown in FIG. 4. The arrows of FIG. 4 indicate the direction of rotation of rollers 98–124. Rollers 100, 104, 114, and 118 are vibrator rollers which oscillate back and forth in a lateral direction with respect to the longitudinal direction of travel of the web 12, thereby operating to spread ink from one ink key zone to adjacent ink key zones.

Figure 5:
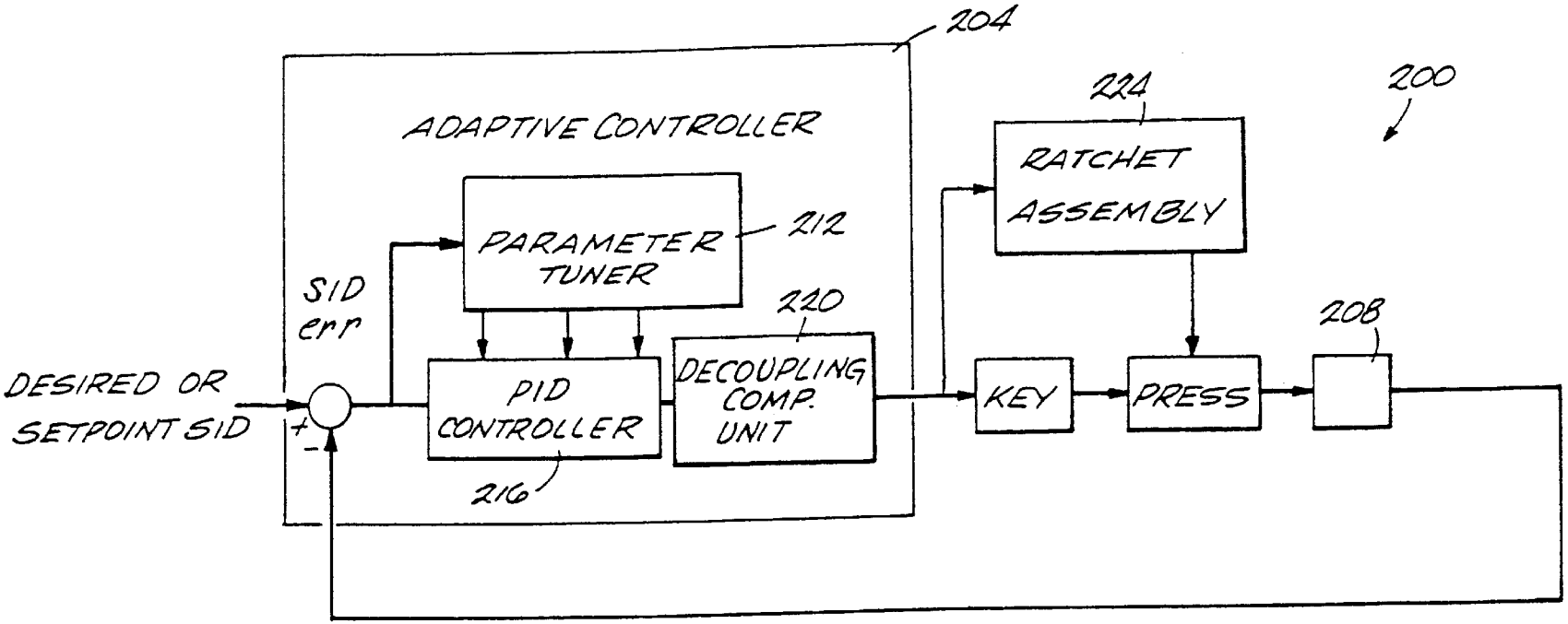
FIG. 5 is a schematic illustration of an ink key control system in accordance with the present invention.

With reference to FIG. 5, the general operation of an ink control system 200 of the present invention is described. In general, the ink control system 200 operates to adjust the settings of the ink metering devices, such as ink keys 54, to control the amount of ink fed to corresponding ink zones on the web 12 of the printing press. The ink control system 200 includes an adaptive control system 204 and a color measuring system 208, such as a color density measuring system, in a feedback loop. Although various ways to measure color values can be utilized, preferably, the color measuring system 208 generates measured solid ink density (SID) values for color bar patches in a color bar oriented transversely across the web 12. It should also be noted that other types of ink color values can be used. There are numerous quantities related to optical density which may prove beneficial in some conditions. It is to be understood that optical density is not constrained to the measuring geometries and spectral conditions prescribed in ISO 5-3 and 5-4. Ink reflectance or colormetric values such as CIELAB and CIELUV may be used. Color measurements based upon optical transmission may also be used.

In terms of feedback control, the adaptive control system 204 operates to maintain the SID values within a desired range for each color patch. The measured SID values are called the controlled variables, and are the ultimate control target of the adaptive control system 204.

In particular, a measured SID value is compared to a desired or setpoint SID value and an SID error signal (SID_err) is generated. The adaptive control system 204 preferably includes a parameter tuner 212, a controller 216 such as a conventional Proportional-Integral-Differential (PID) controller, and optionally, a decoupling computation unit 220. It should be noted that other types of controllers, other than PID controllers, can be utilized in the present invention.

In the preferred embodiment, the parameter tuner 212 adjusts at least one gain parameter of the PID controller 216.

The PID controller 216 provides signals to the decoupling computation unit 220. The decoupling computation unit 220 takes into account the effects of ink key coupling due to the lateral movement of the vibrator rollers 100, 104, 114 and 118 and provides signals to drive the motors 58 to independently control the position of each ink key 54. In operation without the decoupling computation unit 220, the signals from the PID controller 216 are directly provided to the ink keys 54.

Optionally, the adaptive control system 204 can interface with a ratchet assembly 224 to control the angle of rotation per stroke of the ink fountain roller 40.

More specifically, in the preferred embodiment, the color measuring system 208 includes a color CCD video camera mounted on a transport bar that spans across the web. However, other equipment such as a CMOS imager, a densitometer or a Vidicon camera can also be utilized. The color measuring system 208 reports values of solid ink density of solid color patches within a color bar that is oriented transversely across the web 12. A strobe light is flashed at an appropriate time so that the color CCD camera obtains an image of a portion of the color bar on the web 12. The image of the color bar is processed through an algorithm to calculate an accurate SID value for each individual color patch. These SID values are fed to the adaptive control system 204. The camera is moved laterally across the web 12 in a series of steps to acquire sequential images in all the ink zones across the web 12. An example of a color measuring system 208 which accurately measures the optical density of a printed image while the press is running is the color measuring system (CMS) described in U.S. Pat. No. 5,724,259 entitled "SYSTEM AND METHOD FOR MONITORING COLOR IN A PRINTING PRESS", which is hereby incorporated by reference.

Alternately, color density measurement could be performed by a conventional densitometer, such as XRite model 418. Such measurements could be performed directly on the moving web, or on sample sheets off line.

The adaptive control system 204 performs several functions. First, the adaptive control system 204 receives the measured SID value from the color measuring system 208 and calculates:

$$\text{SID_err}(j,k,t)=\text{SID_set_point}\ (j,k,t)-\text{Measured_SID}(j,k,t)$$

where:

j: color index (j=C, M, Y, or K)

k: ink key index across the web (k=1, . . . , 24)

t: sampling time index (t=1, 2, . . . )

The adaptive control system 204 also calculates the trend of the SID_err increment, i.e., the difference between the current SID_err at time t and the previously sampled SID error at time (t−1):

$$\text{SID_derr}(j,k,t)=\text{SID_err}\ (j,k,t)-\text{SID_err}(j,k,t-1)$$

where j, k, and t are defined above.

Figure 6:
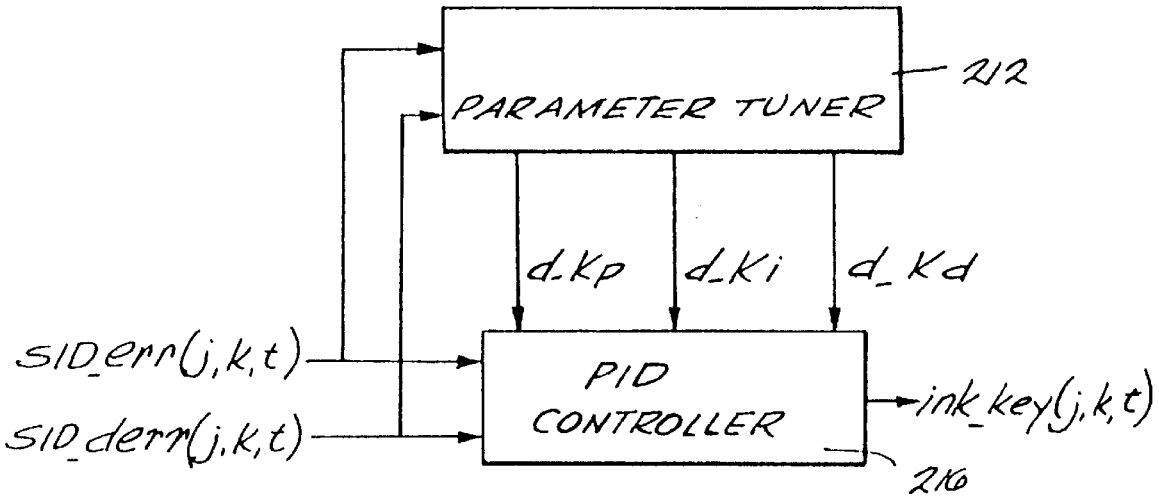
FIG. 6 is a schematic of the relationship between a PID controller and a fuzzy logic parameter tuner.

FIG. 6 illustrates the relationship between the PID controller 216 and the parameter tuner 212. As shown, the two calculated signals, SID_err(j,k,t)(or the SID error signal for color j and ink key k at time t) and SID_derr(j,k,t)(or the change in the SID error signal for color j and ink key k at time t) are fed both to the parameter tuner 212 and the PID controller 216. The PID controller 216 computes the ink key settings to achieve the desired set point SID values for each ink key zone and for each ink color, without accounting for the coupling of the ink keys. The function of the parameter tuner 212 is to adjust at least one of the gain parameters in the PID controller 216 adaptively to compensate for the variations in press performance. There are two ways to adjust the values of the PID gain parameters: 1) a direct output of current PID gain parameter values by the parameter tuner 212, or 2) an indirect or incremental adjustment of the PID parameters. The second method is preferred because it is more stable and reduces drastic swings in parameter values over time.

Hereafter, the following notations are used:

Kp(j,k,t), Ki(j,k,t), and Kd(j,k,t) are the proportional, integral, and differential gain parameters, respectively, used by the PID controller 216 for color j and ink key k at time t. These gain parameters are tuned or optimized in real time by the parameter tuner 212.

d_Kp(j,k,t), d_Ki(j,k,t), and d_Kd(j,k,t) are the incremental adjustments of the Kp, Ki, and Kd parameters, respectively, for color j and ink key k at time t.

ink_key(j,k,t) is the command ink key setting for color j and ink key k at time t, without taking into account ink key coupling.

The overall output of the PID controller 216 is the unadjusted command ink key setting. Since the color measuring system 208 reports the SID values sequentially, the PID controller 216 can be implemented sequentially. The overall output of the PID controller 216 is the linear combination of proportional, integral, and differential terms, as follows:

$$ink_key(j,k,t)=$$

$$Kp(j,k,t)*SID_err(j,k,t)+\left[\sum_{l=1}^{t} Ki(j,k,l)*SID_err(j,k,l)\right]*\Delta T+$$

$$K_{INT}+Kd(j,k,t)*\frac{SID_derr(j,k,t)}{\Delta T}$$

where: $K_{INT}=ink_key(j,k,0)$ $\Delta T$ = time between sample periods

In adaptive control, the parameters Kp, Ki, and Kd of the PID controller 216 are tuned to some "optimal" value in real time. One way to accomplish adaptive control is utilizing fuzzy logic.

Fuzzy logic is based on fuzzy set theory and operates to map an input space to an output space. When used in conjunction with adaptive control, fuzzy logic incorporates the operation knowledge of human experts into a control loop. Fuzzy logic is also useful for modelling nonlinear functions of arbitrary complexity. Fuzzy logic can be blended with conventional control techniques, such as conventional PID control. The embodiment described herein is an example of an indirect fuzzy logic control system. An indirect fuzzy logic control system is used in conjunction with, for example, a conventional PID controller and has the advantage that the control design is separated from the adaptive mechanism. In contrast, a direct fuzzy logic controller generally uses a static incremental process model to relate the error in the calculated control action to the deviation in the desired behavior.

Fuzzy logic includes the concept of fuzzy sets. A fuzzy set is one that does not have clear and crisp boundaries but instead describes a somewhat vague concept. Examples of fuzzy sets are:

The set of old people;

The set of tall people;

The set of high temperatures;

The set of excellent drivers;

The set of poor restaurant service; and

The set of hot weather.

The degree that an item belongs to the fuzzy set is measured by its membership function. A membership function is a curve that defines how each point in the input space is mapped to a membership value (or degree of membership), which is a value between 0 and 1. As an example, a man of age 69 may belong to the fuzzy set of "old people" with a membership value of 0.8 (the degree of belonging to the set). A membership function can be represented by curves of various shapes including, for example, triangular, gaussian, bell shaped, sigmoidal, and polynomial-based curves, as well as others.

Another feature of fuzzy sets is that they do not obey the rule of "mutually exclusive." An item can belong to two or more different fuzzy sets simultaneously. Using the same example above, a man of age 69 could belong to the fuzzy set "young people" with a membership function value of only 0.2 at the same time he belongs to the fuzzy set "old people" with a membership function value of 0.8.

Figure 7:
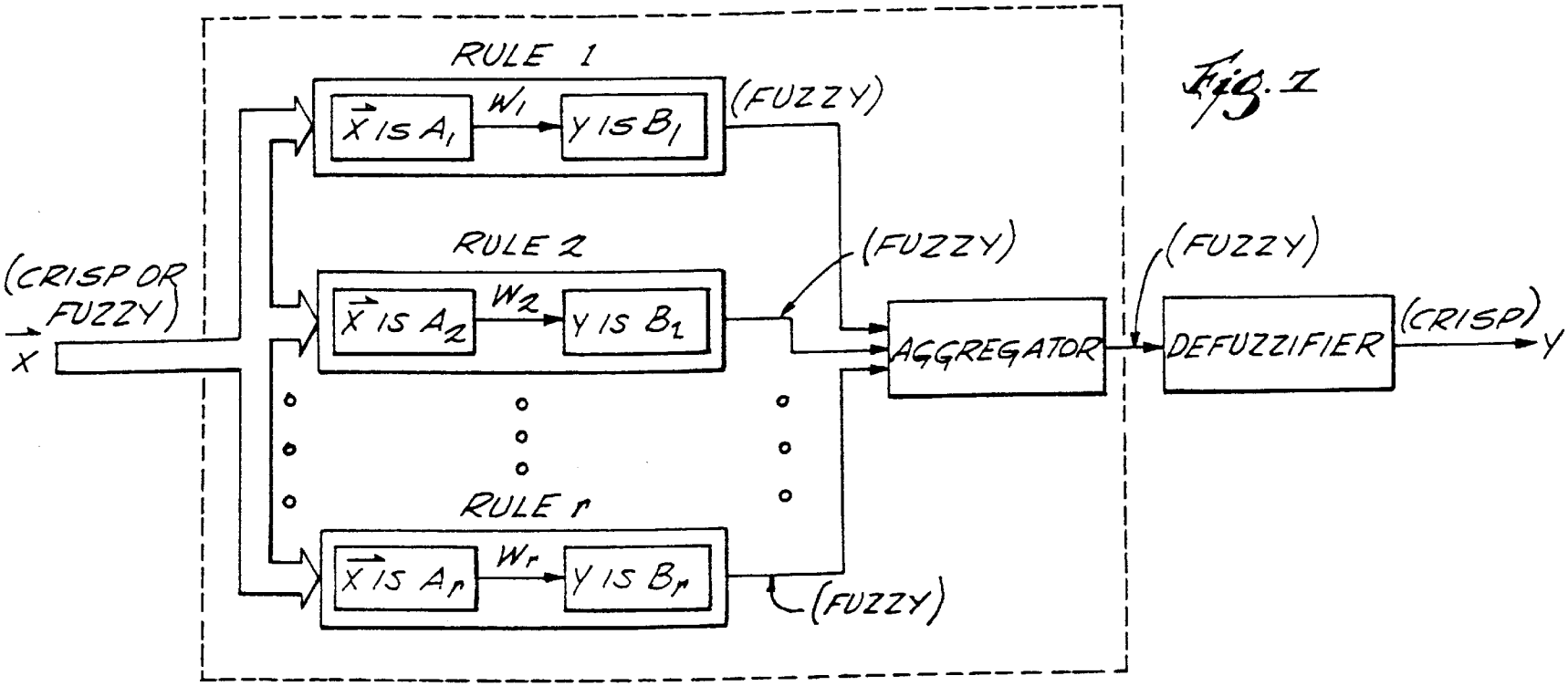
FIG. 7 is a block diagram of a general fuzzy inference system.

A fuzzy inference system, such as that depicted in FIG. 7, is capable of implementing a nonlinear mapping from its input space to an output space. The mapping is accomplished by a number of fuzzy if-then rules, each of which describes the local behavior of the mapping and which reflects certain knowledge of human experts' decision making process. For example, the following rules are an example of a method for determining the size of a tip at a restaurant:

Rule 1: If the food quality is excellent and the service quality is average, then the tip is moderately generous.

Rule 2: If the food quality is poor and the service quality is below average, than the tip is minimal.

The rules establish a simple input-output inference system, where "food quality" and "service quality" are the input fuzzy variables, and the single output fuzzy variable is "the amount of the tip". The antecedent of a rule defines a fuzzy region in the input space, while the consequent specifies a fuzzy region in the output space.

Figure 8:
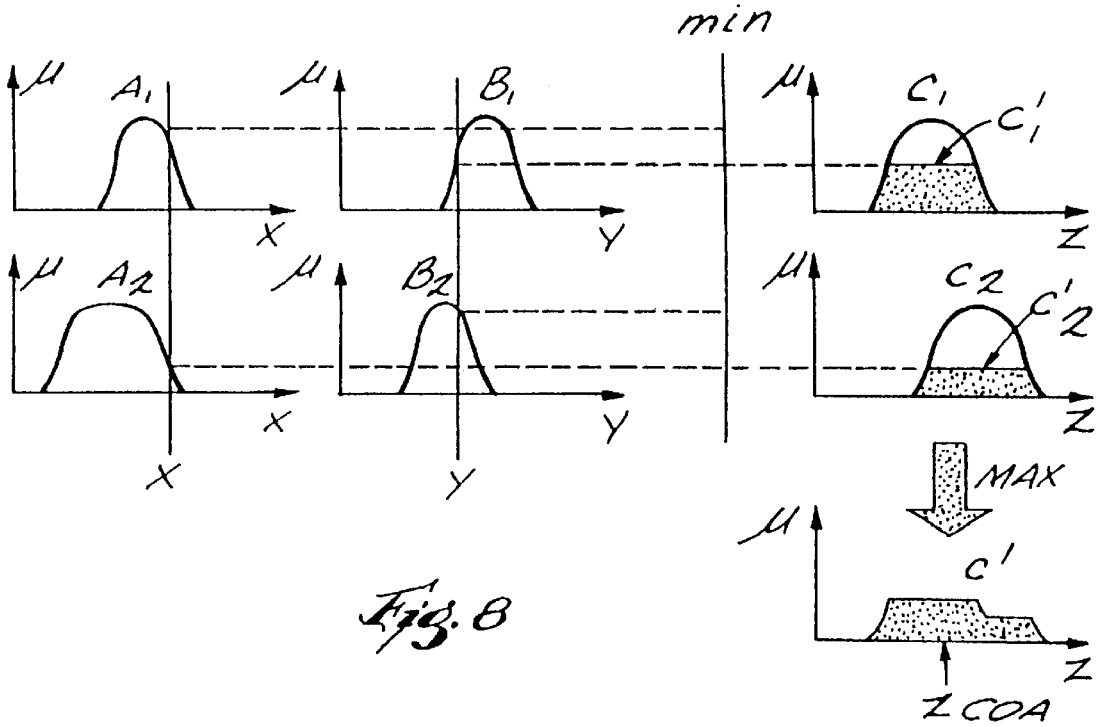
FIG. 8 is an illustration of a Mamdani fuzzy inference system.

A fuzzy inference system basically includes the functions of fuzzification, inferencing, aggregation, and defuzzification. One way to accomplish the above steps is known as the Mamdani fuzzy inference system, which is known in the art. Some of the processing steps involved in the Mamdani fuzzy inference system are illustrated in FIG. 8. The Mamdani inference system includes output membership functions (shown as C1 and C2) which are also fuzzy sets.

Because the inputs to the fuzzy inference system are common crisp values, they must undergo a fuzzification process in order to apply fuzzy if-then rules. Similarly, the results of the multiple fuzzy if-then rules must be aggregated and then defuzzified to generate a crisp output.

Fuzzification is accomplished with the use of a plurality of input membership functions, wherein the membership values of each membership function are determined for a given input variable. The next step is determining which of the if-then rules are activated for the given input variables. An if-then rule is activated if the membership values of the fuzzy variables included in its antecedent are nonzero. Interpreting an if-then rule includes evaluating the antecedent (which involves fuzzifying the input and applying any necessary fuzzy operators) and applying that result to the consequent. If there are two or more fuzzy variables in the antecedent of a rule, the fuzzy operators must be applied. For example, referring to FIG. 8, the output of the statement A, AND B, where A, and B, are within the range (0,1) is determined by min (A, B,) (i.e., the minimum of the two values). Similarly, the output of the statement A OR B, where A and B are within the range (0,1) can be determined by max (A, B) (i.e, the maximum of the two values).

The outputs of the activated rules are aggregated. The output fuzzy sets are aggregated by combining them into a single output fuzzy set, typically using the max operator, as shown in the right portion of FIG. 8. The resulting set is defuzzified, or resolved to a single number.

Various defuzzification methods are known. Defuzzification is the conversion of a fuzzy quantity to a precise quantity. Four known defuzzification methods are described in "Fuzzy Logic with Engineering Applications" by Timothy J. Ross, copyright 1995 by McGraw-Hill, Inc. Preferably, the centroid method, also known as the center of area or center of gravity method, is utilized to perform the defuzzification.

Figure 9:
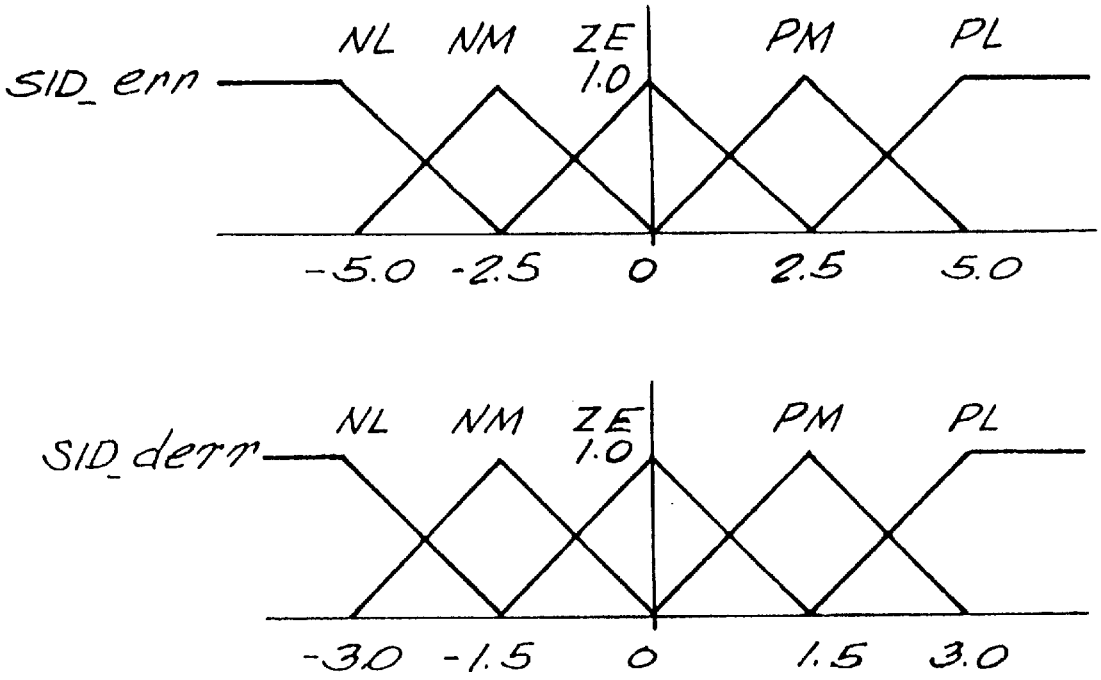
FIG. 9 is an illustration of five input membership functions.

The design and implementation of the parameter tuner 212 using fuzzy logic for the ink key control is accomplished as follows. As previously stated, the basic principle is to build the fuzzy inference system for parameter tuning of the PID parameters. The two fuzzy input variables are SID_err(j,k,t) and SID_derr(j,k,t). Each input variable is fuzzified into a plurality of membership functions. For example, each input variable can be fuzzified into five membership functions, as illustrated in FIG. 9. It should be noted that a different number of membership functions can be employed such as 4, 6 or 7.

In the ink control system 200 described herein, the membership functions are selected to be triangular, and are such that an input has a nonzero value for at most two membership functions simultaneously. The membership functions are as follows:

NL (negatively large)

NM (negatively medium)

ZE (zero)

PM (positively medium)

PL (positively large)

Figure 10:
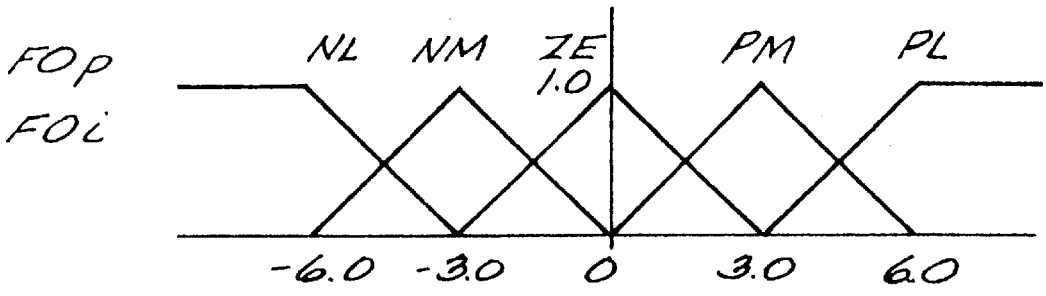
FIG. 10 is an illustration of five output membership functions.

There are two fuzzy output variables, FOp and FOi. The output sets in the preferred embodiment also include five membership functions, as illustrated in FIG. 10.

The following are examples of the if-then rules for the five membership function inference system:

1. If (sid_err is NL) and (sid_derr is NL) then (FOp is NL)(FOi is PL)
2. If (sid_is NL) and (sid derr is NM) then (FOp is NL)(FOi is PL)
3. If (sid_err is NL) and (sid_derr is ZE) then (FOp is PM)(FOi is PL)
4. If (sid_is NL) and (sid_derr is PM) then (FOp is PM)(FOi is PM)
5. If (sid_err is NL) and (sid_derr is PL) then (FOp is ZE)(FOi is ZE)
6. If (sid_err is NM) and (sid_derr is NL) then (FOp is NL)(FOi is PL)
7. If (sid_err is NM) and (sid_derr is NM) then (FOp is NM)(FOi is PM)
8. If (sid_err is NM) and (sid_derr is ZE) then (FOp is PM)(FOi is PM)
9. If (sid_err is NM) and (sid_derr is PM) then (FOp is ZE)(FOi is ZE)
10. If (sid_err is NM) and (sid_derr is PL) then (FOp is ZE)(FOi is ZE)
11. If (sid_err is ZE) and (sid_derr is NL) then (FOp is NM)(FOi is NL)

12. If (sid_err is ZE) and (sid_derr is NM) then (FOp is NM)(FOi is NM)
13. If (sid_err is ZE) and (sid_derr is ZE) then (FOp is ZE)(FOi is ZE)
14. If (sid_err is ZE) and (sid_derr is PM) then (FOp is NM)(FOi is NM)
15. If (sid_err is ZE) and (sid_derr is PL) then (FOp is NM)(FOi is NL)
16. If (sid_err is PM) and (sid_derr is NL) then (FOp is ZE)(FOi is NM)
17. If (sid_err is PM) and (sid_derr is NM) then (FOp is ZE)(FOi is ZE)
18. If (sid_err is PM) and (sid_derr is ZE) then (FOp is PM)(FOi is PM)
19. If (sid_err is PM) and (sid_derr is PM) then (FOp is NM)(FOi is PM)
20. If (sid_err is PM) and (sid_derr is PL) then (FOp is NL)(FOi is PL)
21. If (sid_err is PL) and (sid_derr is NL) then (FOp is ZE)(FOi is ZE)
22. If (sid_err is PL) and (sid_derr is NM) then (FOp is PM)(FOi is PM)
23. If (sid_err is PL) and (sid_derr is ZE) then (FOp is PM)(FOi is PL)
24. If (sid_err is PL and (sid_derr is PM) then (FOp is NL)(FOi is PL)
25. If (sid_err is PL) and (sid_derr is PL) then (FOp is NL)(FOi is PL)

The fuzzy output variables are then used in the following equations:

$$FAp(j,k,t)=FAp(j,k,t-1)+alphaP(j)*FOp(j,k,t)$$

where: FAp is the fuzzy accumulator output for the proportional term, and FOp is the fuzzy tuner output for the proportional term.

$$FAi(j,k,t)=FAi(j,k,t-1)+alphaI(j)*FOi(j,k,t)$$

where: FAi is the fuzzy accumulator output for the integral term and FOi is the fuzzy tuner output for the integral term.

The alphaP and alphaI terms each take a proportion of its associated fuzzy tuner output and add that to the fuzzy accumulator. This step is intended to make the tuning process more stable.

The equations used to update the PID parameters are as follows:

$$Kp(j,k,t)=FAp(j,k,t)*MaxPGain(j)*COVERAGE(j,k)$$

$$Ki(j,k,t)=FAi(j,k,t)*MaxIGain(j)*COVERAGE(j,k)$$

$$Kd(j,k,t)=FAi(j,k,t)*MaxDGain(j)*COVERAGE(j,k)$$

where:

Kp(j,k,t), Ki(j,k,t), Kd(j,k,t) are the gain parameters for the PID controller;

MaxPGain(j), MaxIGain(j), and MaxDGain(j) are empirically determined constants for each ink color; and COVERAGE(j,k) is the plate coverage value for color j for each ink key k.

In the preferred embodiment, COVERAGE(j,k) is set to 0.20 for all keys for all colors. However, the actual values of plate coverage for each ink key zone, if available, can be used to achieve faster convergence. Also, note that the FAi term is used in the calculation of Kd. However, a separate FAd term can be determined, using a FOd term as an output of the inference rules.

From the above, it follows that the incremental adjustment of the gain parameters are:

$$d_Kp(j,k,t)=alphaP(j)*FOp(j,k,t)*MaxPGain(j)*COVERAGE(j,k)$$

$$d_Ki(j,k,t)=alphaI\ (j)*FOi(j,k,t)*MaxIGain(j)*COVERAGE(j,k)$$

$$d_Kd(j,k,t)=alphaI\ (j)*FOi(j,k,t)*MaxDGain(j)*COVERAGE(j,k)$$

A list of the exemplary values pertaining to the Harris M1000B printing press used in the preceding equations are as follows:

BLACK (j=K)
- MaxPGain=15
- MaxIGain=45
- MaxDGain=20
- AlphaP=0.05
- AlphaI=0.10

CYAN (j=C)
- MaxPGain=20
- MaxIGain=30
- MaxDGain=25
- AlphaP=0.08
- AlphaI=0.10

MAGENTA (j=M)
- MaxPGain=20
- MaxIGain=35
- MaxDGain=25
- AlphaP=0.08
- AlphaI=0.15

YELLOW (j=Y)
- MaxPGain=20
- MaxIGain=60
- MaxDGain=25
- AlphaP=0.15
- AlphaI=0.30

The initial values of Kp, Ki, Kd can be determined by the known Ziegler-Nichols method.

As a further example, an input set including six membership functions instead of five can be defined. In this case, the six input membership functions could be the same as the five membership functions previously defined, with the exception that ZE is divided into two functions, termed PZE (positive zero) and NZE (negative zero). With five output sets, the fuzzy logic adaptive controller 216 could use the following inference rules:

1. If (sid_err is NL) and (sid_derr is NL) then (pgain is NL)(igain is PL)(dgain is PL)
2. If (sid_err is NL) and (sid_derr is NM) then (pgain is NL)(igain is PL)(dgain is PM)
3. If (sid_err is NL) and (sid_derr is NZE) then (pgain is PM)(igain is PM)(dgain is ZE)
4. If (sid_err is NL) and (sid_derr is PZE) then (pgain is PM)(igain is PM)(dgain is ZE)
5. If (sid_err is NL) and (sid_derr is PM) then (pgain is PM)(igain is PM)(dgain is NM)
6. If (sid_err is NL) and (sid_derr is PL) then (pgain is ZE)(igain is ZE)(dgain is NL)
7. If (sid_err is NM) and (sid_derr is NL) then (pgain is NL)(igain is PL)(dgain is PL)
8. If (sid_err is NM) and (sid_derr is NM) then (pgain is NM)(igain is PM)(dgain is PM)

9. If (sid_err is NM) and (sid_derr is NZE) then (pgain is PM)(igain is PM)(dgain is ZE)
10. If (sid_err is NM) and (sid_derr is PZE) then (pgain is PM)(igain is ZE)(dgain is ZE)
11. If (sid_err is NM) and (sid_derr is PM) then (pgain is ZE)(igain is ZE)(dgain is ZE)
12. If (sid_err is NM) and (sid_derr is PL) then (pgain is ZE)(igain is NM)(dgain is NM)
13. If (sid_err is NZE) and (sid_derr is NL) then (pgain is NM)(igain is PL)(dgain is PL)
14. If (sid_err is NZE) and (sid_derr is NM) then (pgain is NM)(igain is PM)(dgain is PM)
15. If (sid_err is NZE) and (sid_derr is NZE) then (pgain is ZE)(igain is ZE)(dgain is ZE)
16. If (sid_err is NZE) and (sid_derr is PZE) then (pgain is ZE)(igain is ZE)(dgain is ZE)
17. If (sid_err is NZE) and (sid_derr is PM) then (pgain is NM)(igain is NL)(dgain is PM)
18. If (sid_err is NZE) and (sid_derr is PL) then (pgain is NM)(igain is NL)(dgain is PL)
19. If (sid_err is PZE) and (sid_derr is NL) then (pgain is NM)(igain is NL)(dgain is PL)
20. If (sid_err is PZE) and (sid_derr is NM) then (pgain is NM)(igain is NM)(dgain is PM)
21. If (sid_err is PZE) and (sid_derr is NZE) then (pgain is ZE)(igain is ZE)(dgain is ZE)
22. If (sid_err is PZE) and (sid_derr is PZE) then (pgain is ZE)(igain is ZE)(dgain is ZE)
23. If (sid_err is PZE) and (sid_derr is PM) then (pgain is NM)(igain is PM)(dgain is PM)
24. If (sid_err is PZE) and (sid_derr is PL) then (pgain is NM)(igain is PL)(dgain is PL)
25. If (sid_err is PM) and (sid_derr is NL) then (pgain is ZE)(igain is NM)(dgain is NM)
26. If (sid_err is PM) and (sid_derr is NM) then (pgain is ZE)(igain is ZE)(dgain is ZE)
27. If (sid_err is PM) and (sid_derr is NZE) then (pgain is PM)(igain is ZE)(dgain is ZE)
28. If (sid_err is PM) and (sid_derr is PZE) then (pgain is PM)(igain is PM)(dgain is ZE)
29. If (sid_err is PM) and (sid_derr is PM) then (pgain is NM)(igain is PM)(dgain is PM)
30. If (sid_err is PM) and (sid_derr is PL) then (pgain is NM)(igain is PL)(dgain is PL)
31. If (sid_err is PL) and (sid_derr is NL) then (pgain is ZE)(igain is ZE)(dgain is NL)
32. If (sid_err is PL) and (sid_derr is NM) then (pgain is PM)(igain is PM)(dgain is NM)
33. If (sid_err is PL) and (sid_derr is NZE) then (pgain is PM)(igain is PM)(dgain is ZE)
34. If (sid_err is PL) and (sid_derr is PZE) then (pgain is PM)(igain is PM)(dgain is ZE)
35. If (sid_err is PL) and (sid_derr is PM) then (pgain is NL)(igain is PL)(dgain is PM)
36. If (sid_err is PL) and (sid_derr is PL) then (pgain is NL)(igain is PL)(dgain is PL)

As previously stated, the effective ink key settings from the PID controller 216 can be used to directly control the ink keys, or can be further processed by the decoupling computation unit 220 to generate adjusted or actual ink key settings.

The problem of ink key coupling is due to the spread of ink by the movement of the vibrator rollers. If the adaptive control system 204 determines that the ink flow to a particular ink key zone should be increased, because the increased ink amount spreads to adjacent ink key zones, increasing the ink flow to one zone will also increase the ink flow to neighboring zones. In order to compensate for this, the ink flow to neighboring keys must be decreased. This will have an effect on the neighboring ink keys as well.

Before describing one method to compensate for ink spread, it is necessary to describe different ways the color control system 200 can operate to control the ink keys with a color measuring system 208 which makes measurements sequentially and laterally across the web rather than making all of the measurements at essentially the same time. One side of a web has 24 ink key zones, which correspond to 24 SID measurements. One method to implement the system is to wait until all 24 SID measurements are obtained, and then change all 24 ink key readings at once. However, this method is slow. Another way to implement the system is to change an ink key immediately after the corresponding SID measurement is obtained, without accounting for the effects of neighboring ink keys. In this case, the method will eventually stabilize, but it does not take into account the effects of neighboring ink keys.

An ink key distribution function or ink key spread function can be determined which represents the spread of ink from a source of ink which is the width of an ink key zone. The ink key spread function can be represented by a vector whose elements are representative of ink amounts in a corresponding zone. One way to determine an ink key spread vector is to open one ink key and see how ink is spread into adjacent ink key zones. For example, one such test resulted in the following vector V:

$$v=[0.007\ 0.009\ 0.016\ 0.043\ 0.196\ 0.460\ 0.196\ 0.043\ 0.016\ 0.009\ 0.007]$$

Vector V is obtained by averaging experimentally obtained ink film thickness values over the width corresponding to each ink key zone, and then scaling so that the addition of all vector elements adds up to 1. The elements in vector V can then be interpreted as the fraction of ink which is distributed to a specific ink key zone. Each ink key results in its own distribution of ink, which is proportional to the ink key opening. In one test on the Harris M1000B press, 46% of the ink provided by a given ink key is passed directly into its corresponding ink key zone, 20% is passed to the immediate neighboring zones, and 4% is passed to the next set of neighbors, and so on.

The effects of the vibrator rollers are taken into account by the decoupling computation unit 220 of FIG. 1. Mathematically, this is a deconvolution in which one seeks to find the ink key settings given an ink key distribution function and the effective ink key settings. In the preferred embodiment of the ink control system 200, however the SID measurements for respective ink key zones reach the PID loop serially in time rather than all at once.

A matrix equation can be written which relates actual and effective ink key openings:

$$E=S\ A$$

where E is a vector representing the effective ink key openings, and A is a vector representing the actual ink key openings, and S is an ink key spread matrix, determined from vector V. E and A are both a 24 by 1 element vectors. S is a 24 by 24 element matrix. (The size is determined by the fact that there are 24 ink keys on the Harris M1000B press). If the ink spread is invariant across the ink keys, then matrix S is a Toeplitz matrix, that is, a matrix in which each row is a shifted version of the row above. Each row contains the elements of the vector V. Matrix S is illustrated in FIG. 11.

The above equation can be rewritten to solve for A:

$$A=S^{-1}E$$

The inverted matrix includes entries in each of the 24 columns. Thus to multiply E by a row of $S^{-1}$ requires the use of all 24 entries. This may add an unacceptable delay. In the preferred embodiment, an approach to solving this problem is to approximate $S^{-1}$ with a matrix $M^{-1}$ which approximates what $S^{-1}$ does. That is, $M^{-1}$ approximates an inverse spread function. One approximation of $M^{-1}$ is illustrated in FIG. 12. Matrix $M^{-1}$ is a symmetric matrix, and the numbers used to derive this matrix are 0.518, 0.196 and 0.045. In other words, for any ink key zone, it is assumed that 51.8% of the ink remains in that zone, 19.6% goes to immediate neighbors, and 4.5% goes to the neighbors two zones away. Using $M^{-1}$ instead of $S^{-1}$, because there are at most 5 entries in a row of $M^{-1}$, it is necessary to obtain at most 5 SID measurements at a given time before an ink key change can be implemented. The numbers 0.518, 0.196 and 0.045 are a particular set of spread coefficients that will produce convergence of the control loop.

Use of the matrix $M^{-1}$ may introduce edge effects in the calculated ink key settings for the ink keys on each end. The edge effects are due to the fact that at an end, an increased ink amount for an ink key will affect the amount of ink fed to the adjacent keys on one side only. One approach to more accurately computing the ink key settings for the ink keys on the ends may be accomplished by modifying the element values in the matrix $M^{-1}$. For example, the ink that theoretically would be fed to a side of the web is accounted for by including that amount in the amount of ink fed to the end ink key zone. In other words, the element in the first row, first column of $M^{-1}$ would be increased by adding [(0.196+0.045)/0.518]. Similarly, the element in the second row, first column of $M^{-1}$ would be increased by adding (0.045/0.518). The ink key settings for the affected ink key settings on the other side of the web would be taken into account by modifying the elements in the last column of the last and second to last rows. The element in the last row, last column would be increased by adding [(0.196+0.045)/0.518]. Also, the element in the second to last row, last column would be increased by adding (0.045/0.518). Various other refinements are possible to account for edge effects.

In the preferred embodiment, the control loop operates with the following constraints: if the measured SID value is within 0.1 of the desired SID value, then the PID controller 216 operates without using the parameter tuner 212 to tune the PID gain parameters, because of concern that the rule set is not optimized at that range. Preferably, there is a dead band zone. If the SID value is within a predetermined range, such as 0.01 or 0.1, and more particularly 0.05, of the desired SID value, the PID controller 216 does not operate to make further adjustments to the ink key settings.

Because both the ink key settings and the ratchet assembly rotation angle control the amount of ink fed to the respective ink key zones, it is possible to change the ink key settings and/or the ratchet setting R in the ratchet assembly. In theory, any ratchet setting is acceptable. In practice, however, there are constraints on the ratchet setting. Ratchet settings which are too low may require ink key openings which are beyond the physical limits of the ink key. On the other hand, setting the ratchet too high leads to very low ink key openings, and a greater sensitivity of ink film thickness to changes in ink key opening. This reduces the precision in the ink key opening.

The optimal condition is met when the ratchet setting is as low as possible without forcing the ink key openings beyond a certain fraction of the physical limit. This fraction is necessary to allow room for subsequent adjustment.

One complication which may occur is that the control algorithm may call for an ink key setting which is beyond the physical limits of an ink key. For example, the requested ink key setting may be for an opening greater than 100%, or for a setting which is negative. In the simplest implementation, requested ink key openings which are out of range are merely clipped, so that they do not go beyond the extreme values.

In the preferred embodiment, there are separate actions for an ink key being requested to move above 100%, and for an ink key being requested to move to less than zero. In the former case, it may still be possible to attain the proscribed density by increasing the ratchet setting. To accomplish this, the ratchet setting is increased by such an amount as to bring the requested ink key setting within the physical limits.

Since the ratchet setting and the ink key opening are multiplicative, the correction is straightforward. If, for example, the requested ink key opening is 120%, the current ratchet setting must be increased to at least 1.2 times its current value. In this case, the new ink key opening would be set to 100%. Alternatively, it may be preferred to increase the ratchet setting 10% higher in order to allow for some further range of adjustment.

When the ratchet setting is changed, all the ink key openings must be compensated accordingly. If the ratchet setting is increased by multiplying by Q, the ink key openings must all be decreased by dividing by Q.

Figure 13:
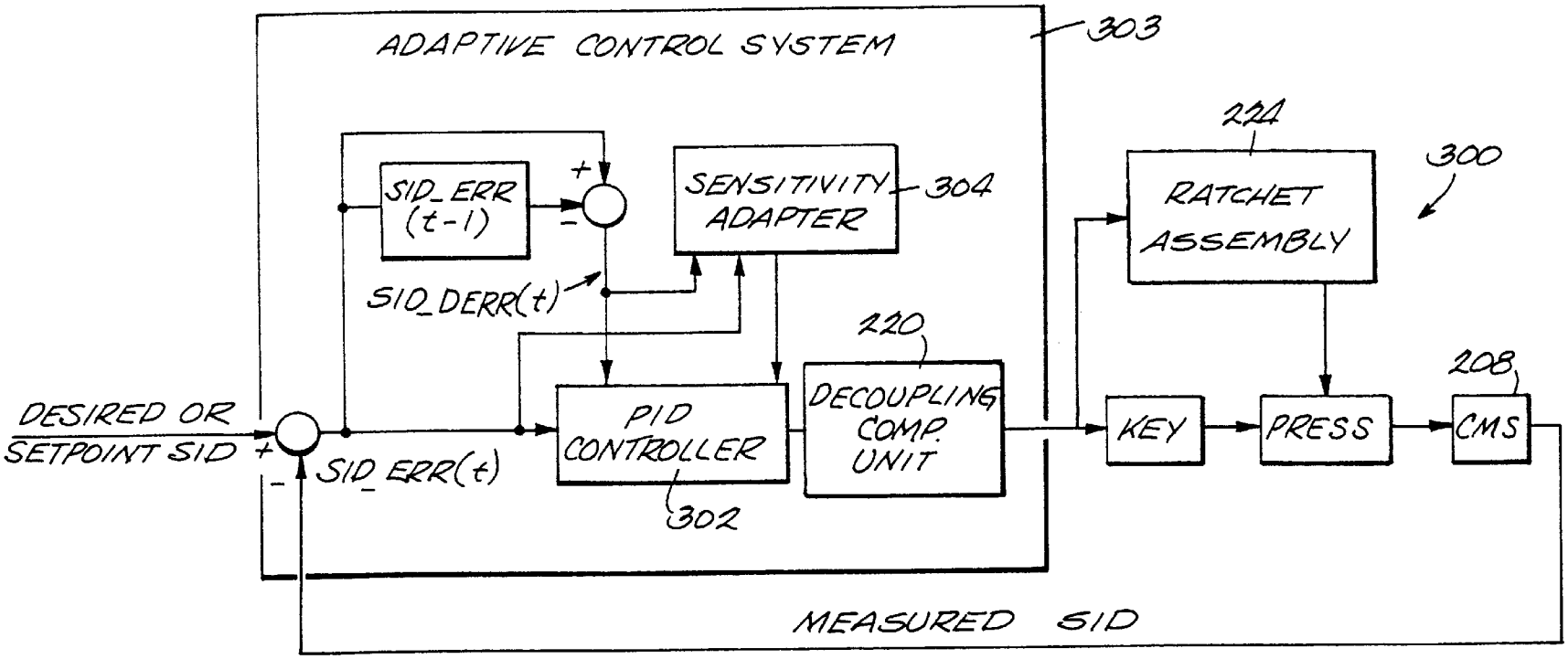
FIG. 13 is a schematic illustration of a second embodiment of the ink key control system in accordance with the present invention.
Figure 14:
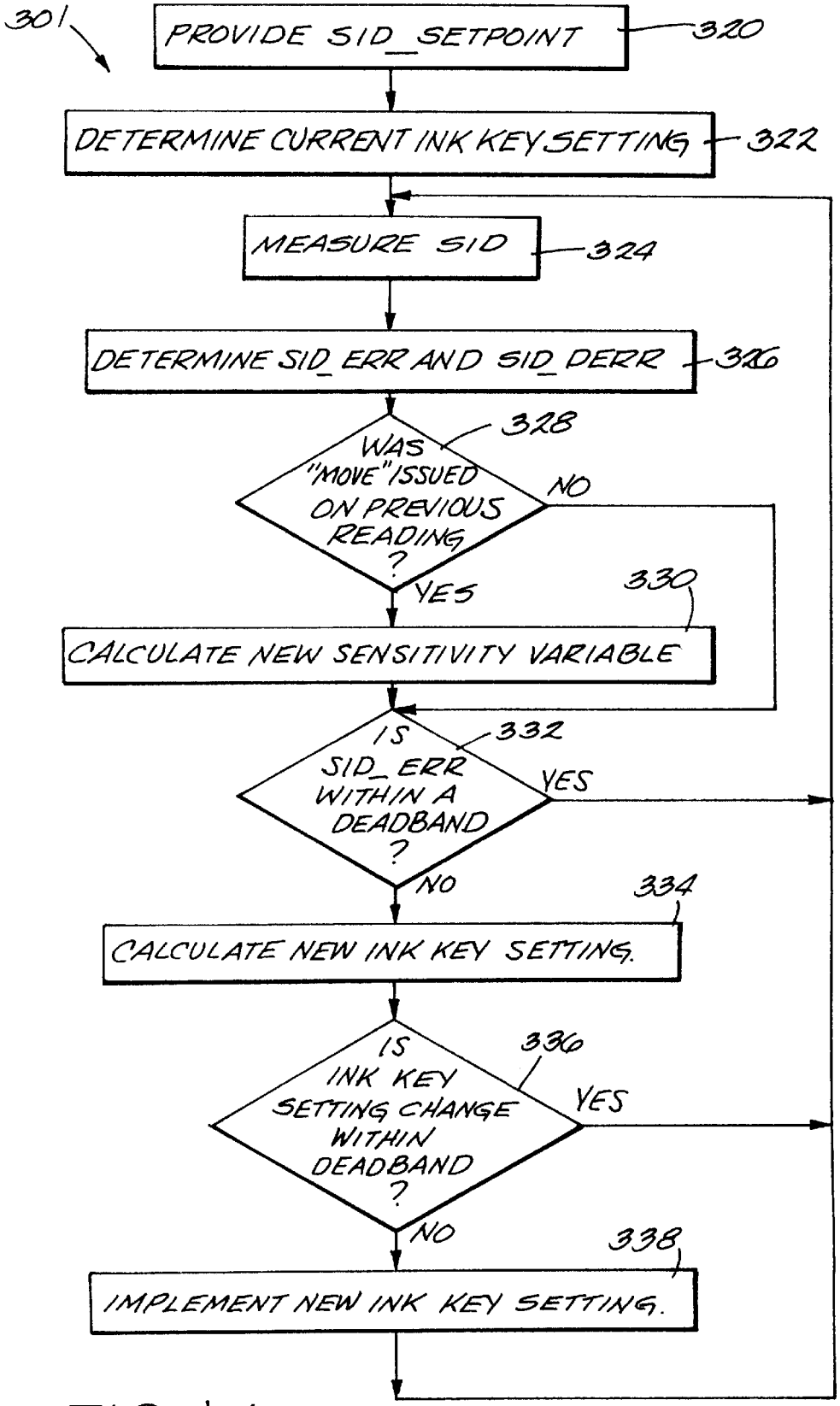
FIG. 14 is a flow chart which illustrates the control algorithm of the second embodiment of the ink key control system.

Illustrated in FIGS. 13 and 14 is a second embodiment of an ink key control system 300 and method 301 for controlling ink fed to a substrate of the printing press, wherein like reference numerals refer to common elements described with respect to the first embodiment.

The second embodiment of the ink key control system 300 also includes an adaptive control system 303 which operates to maintain the SID values within a desired range for each color patch. The adaptive control system 303 preferably utilizes a conventional PID controller 302 in conjunction with a sensitivity adapter 304, and optionally, a decoupling computation unit 220. The sensitivity adapter 304 is similar to the parameter tuner 212 shown in FIG. 5, although the methods used by each to perform adaptive control are somewhat different. It should be noted that other conventional controllers, such as P, PI, or PD controllers could also be utilized in conjunction with the ink key control system 300. The decoupling computation unit 220 takes into account the effects of ink key coupling due to the lateral movement of the vibrator rollers, and provides signals to control the position of each ink key. In operation without the decoupling computation unit 220, the signals from the PID controller 302 are directly provided to the ink keys. The adaptive control system 303 can also optionally interface with a ratchet assembly 224 to control the angle of rotation per stroke of the ink fountain roller. The adaptive control system could also be adapted to interface with a metering roll system or ink spray device instead of the ratchet assembly. The color measuring system 208 operates to provide solid ink density values for the color bar patches as described above.

The sensitivity adapter 304 adaptively compensates for non-linearities in the printing press and environment and changes in conditions while the press is running. Preferably, there is one sensitivity adapter 304 per ink key. Additionally, one sensitivity adapter per print unit could be employed to calculate a ratchet position based on the sensitivities of all of the ink keys in that print unit. For example, an appropriate ratchet setting would be determined to obtain center of range operation if all the ink key settings are high or low.

In particular, and with reference to FIGS. 13 and 14, for a specific ink key, the adaptive control system 303 receives as input the SID_setpoint value in step 320. In step 322, the current ink key setting is determined. In step 324, the system 303 receives the measured SID value from the color measuring system and in step 326 calculates:

$$\text{SID_err}(j,k,t)=\text{SID_set_point}\ (j,k,t)-\text{Measured_SID}(j,k,t)$$

where:

j: color index (j=C, M, Y, or K)

k: ink key index across the web (k=1, . . . , 24)

t: sampling time index (t=1, 2, . . . )

In step 326, the adaptive control system 303 also calculates the trend of the SID_err increment, i.e., the difference between the current SID_err at time t and the previously sampled SID error at time (t−1):

$$\text{SID_derr}(j,k,t)=\text{SID_err}\ (j,k,t)-\text{SID_err}(j,k,t-1)$$

The sensitivity adapter 304 monitors the effectiveness or sensitivity of each move that the PID controller 302 generates in real time; i.e., how the solid ink density responds to a correction issued by the PID controller while the press is running. Changes in the press and the press environment occur in real time, so that the sensitivity adapter 304 adaptively compensates for these changes in real time. An ink key can be over-sensitive in responding to a correction or can be under-sensitive. For example, an over-sensitive key requires a decrease in the sensitivity variable (less gain). Similarly, an under-sensitive key requires an increase in the sensitivity variable (more gain). The sensitivity adapter 304 preferably accounts for both over-sensitivity and under-sensitivity of the ink keys. However, it should be noted that the sensitivity adapter 304 of the present invention could be designed to accommodate only under-sensitivity or only over-sensitivity.

In step 328, the controller determines whether a command was issued to move the ink key on the previous reading. If a move signal was issued on the previous reading, then a new sensitivity variable is calculated in step 330. If a move signal was not issued on the previous reading, then a new sensitivity variable is not calculated, and processing proceeds to step 332.

The sensitivity adapter 304 utilizes gain modification to adjust for the relative sensitivity of an ink key. The sensitivity adapter 304 produces a sensitivity variable that is multiplied by each of the nominal gain parameters of the PID controller 302 to produce new effective gain parameters. The sensitivity variable attempts to correct for a pre-selected desired percentage of the error in ink density, such as 80%, with each correction issued by the PID controller 302. It should be noted that other pre-selected desired correction percentages could also be employed, such as any amount from approximately 70–100%. A percentage of the error less than 100% is chosen so that the system is over-damped, that is, the ink key density gradually converges to the target value without oscillating around the target value. Over-damping is desired because the amount of ink controlled by one ink key also has an affect on the amount of ink in adjacent ink key zones. Additionally, if the measured density is too low to begin with, it is generally easier to add ink and account for the ink effects rather than add too much ink and have to remove ink from the system. If the measured density is too high at first, an over-damped system is still desired to prevent oscillation around the target value.

In order to modify the effective gain parameters in the PID controller, the sensitivity adapter 304 calculates an updated sensitivity variable which is then multiplied by each of the nominal gain parameters in the PID controller 302. The sensitivity variable multiplied by each of the nominal gain parameters produces effective gain parameters. This adaptive control method incrementally modifies the sensitivity variable based upon a weighted difference between the desired correction percentage (for example, 80%) and the actual correction percentage measured for that ink key. For instance, if a previous move was intended to correct for 80% of an observed density error, and a subsequent measurement indicated that only 30% of the error was corrected, then the sensitivity variable for the ink key is increased. The amount of weighting is selected to control the rate at which the sensitivity variable can change. The amount of weighting is based upon the magnitude of the ink density error that is being corrected. Preferably, the weighting is higher for a larger error, and is smaller for a lower error. This prevents overreaction to random noise.

As mentioned, the sensitivity adapter 304 calculates a new sensitivity variable for an individual ink key after every correction that is implemented. At step 330, the new sensitivity variable is calculated as the previous sensitivity variable for that ink key plus the previous sensitivity variable multiplied by a weighted modifier multiplied by the difference between the desired correction percentage and the absolute value of the actual correction percentage. In equation form:

$$S(j,k,t)=S(j,k,t-1)+S(j,k,t-1)*CW*(TCP-|PCP|)$$

where:

$S(j,k,t)$ is the new sensitivity variable for color $j$ and ink key $k$;

$S(j,k,t-1)$ is the previous sensitivity variable for color $j$ and ink key $k$;

$CW$ is the weighted modifier;

$TCP$ is the target or desired correction percentage (in decimal form); and $PCP$ is the previous correction percentage = $\dfrac{SID_err(j,k,t-1)-SID_err(j,k,t)}{SID_err(j,k,t-1)}$ If the magnitude of the SID_err at time t increases with respect to the SID_err at time t−1 (i.e., it becomes more positive or more negative), then the PCP value is set to zero.

Preferably, the weighted modifier CW is determined using the following equation:

$$CW=|\text{SID_err}(j,k,t-1)/\text{CRC}|$$

where:

CW is bounded between 0 and 1; and

CRC is a change rate control value.

The weighted modifier is optional and controls the rate at which the sensitivity variable can change to ensure that the system response is stable. Specifically, the change rate control value is chosen to limit the amount of change of the sensitivity variable in order to maintain stability of the control system. The weighted modifier is larger for a large SID_err value as compared to a smaller SID_err value because the formula is more sensitive to noise when the SID_err is small. For the Harris M1000B printing press, preferably the change rate control value is set to 0.3 density units. This value empirically is at the high end of the typical range of density errors seen during make-ready when the ink key sensitivity needs to adjust quickly to provide a fast convergence to the target density.

The desired correction percentage is pre-selected as described above. For the Harris M1000B printing press, a desired correction percentage of 80% provides an efficient convergence toward the target ink density level while maintaining stability of the system response.

At start-up, the previous sensitivity is initialized to a selected non-zero value, such as S(j,k,0)=3. In an alternate embodiment, if the plate coverage for an ink key zone is known, a better estimate for the initial sensitivity variable can be determined based upon previous jobs having similar plate coverage.

At step 332, the adaptive control system determines whether the SID_err value is within a predetermined dead-band. For example, if the absolute value of the SID_err is less than a predetermined amount, such as 0.03 or 0.035 density units, the ink key settings remain unchanged, and processing instead proceeds to step 324. If the SID_err is not within the predetermined dead-band, then a new ink key setting is determined at step 334.

At step 334, the sensitivity adapter 304 communicates the new sensitivity value S(j,k,t) to the PID controller 301 to be multiplied by each of the P, I, and D nominal gain parameters (Kp, Ki and Kd) to adaptively adjust these gain parameters. A new ink key setting is then calculated. In equation terms, the new position of an ink key for color j and key k is calculated as follows:

$$inkkey(j,k,t) = S(j,k,t) * Kp(j,k,t) * SID_err(j,k,t) + \left[\sum_{l=1}^{t} Ki(j,k,l) * SID_err(j,k,l) * S(j,k,l) * \Delta T_1\right] + K_{INT} + S(j,k,t) * Kd(j,k,t) * (SID_derr(j,k,t)/\Delta T)$$

$$\text{where } K_{INT} = inkkey(j,k,0).$$

Kp, Ki and Kd are the nominal gain parameters. Multiplying the sensitivity variable by the nominal gain parameters produces effective gain parameters for the controller. In the preferred embodiment, Kd=0.

At step 336, it is determined whether the change in the ink key settings (from previous to new) is within a predetermined dead-band. If so, the new ink key setting is not implemented, and processing proceeds to step 324. If the ink key setting change is not within the dead-band, then processing proceeds to step 338, and the new ink key setting is implemented.

The newly calculated position of each ink key can be implemented in several ways when using sequential SID readings of color patches.

In a first method, if the press has 24 ink key zones which correspond to 24 SID measurements, all the ink key corrections can be implemented at once after all 24 SID measurements (or a subset thereof) have been obtained and the new positions calculated.

In a second method, the position of an individual ink key is changed immediately after the corresponding SID measurement is obtained and the new position is calculated.

The adaptive control system of the present invention is operable both during make-ready and during run-time.

The adaptive control system 303, and in particular the sensitivity adapter 304, can also be implemented with fuzzy logic.

It is understood that the invention is not confined to the particular construction and arrangement of parts herein illustrated and described, but embraces all such modified forms thereof as may come within the scope of the following claims. It will be apparent that many modifications and variations are possible in light of the above teachings. For example, the ratchet assembly may be replaced by a metering roller or ink spray device.

It therefore is to be understood that within the scope of the appended claims, the invention may be practiced other than is specifically described. Alternative embodiments and variations of the method taught in the present specification may suggest themselves to those skilled in the art upon reading of the above description. Various other features and advantages of the invention are set forth in the following claims.

What is claimed is:

1. An adaptive control system for use in conjunction with a printing press to control the setting of an ink control device that regulates the amount of ink applied to a substrate so that a measured ink color value on the substrate converges toward a target ink color value, the system comprising:

a controller using at least one gain parameter and operating to calculate a new setting of the ink control device based upon the at least one gain parameter and an ink color value difference that is the difference between the measured ink color value and the target ink color value; and a sensitivity adapter in communication with the controller to adaptively modify the at least one gain parameter, wherein the sensitivity adapter calculates a sensitivity variable that is multiplied by the at least one gain parameter, wherein the sensitivity variable at time (t+1) is determined by comparing a desired ink color correction amount with an actual ink color correction amount, and wherein the actual ink color correction amount is obtained by comparing the ink color value difference at time (t) with the ink color value difference at time (t+1).

2. The adaptive control system of claim 1 wherein the difference between the desired ink color correction amount and the actual ink color correction amount is multiplied by a weighted modifier to control the rate at which the gain parameter is adjusted.

3. The adaptive control system of claim 2 wherein the weighted modifier is dependent upon the difference between the measured ink color value and the target ink color value.

4. The adaptive control system of claim 3 wherein the weighted modifier is dependent upon the difference between the measured ink color value at time (t) and the target ink color value.

5. The adaptive control system of claim 4 wherein the desired ink color correction amount is in the range of 70% to 100%.

6. The adaptive control system of claim 4 wherein the desired ink color correction amount is approximately 70%.

7. The adaptive control system of claim 1 wherein the controller includes a PID controller.

8. The adaptive control system of claim 7 wherein the at least one gain parameter includes each of the integral and proportional gain parameters of the PID controller.

9. A method for controlling ink fed by an ink control device to a substrate in a printing press, the method comprising:

providing a target ink color value for the ink on the substrate;

measuring an actual ink color value of the ink on the substrate at time (t);

calculating an ink color error at time (t) which is the difference between the target ink color value and the actual ink color value measured at time (t);

measuring an actual ink color value of the ink on the substrate at time (t+1);

calculating an ink color error at time (t+1) which is the difference between the target ink color value and the actual ink color value measured at time (t+1);

determining a desired ink color correction amount;

determining an actual ink color correction amount which is obtained by comparing the ink color error at time (t) with the ink color error at time (t+1);

calculating a sensitivity variable at time (t+1) based upon the difference between the desired ink color correction amount and the actual ink color correction amount;

multiplying the sensitivity variable at time (t+1) by a nominal gain parameter to calculate an effective gain parameter at time (t+1) for a controller; and using the controller to calculate a new position of the ink control device based upon the ink color error at time (t+1) and the effective gain parameter at time (t+1) such that the measured ink color value converges toward the target ink density value.

10. The method of claim 9 wherein the actual ink color value is an ink density value.

11. The method of claim 10 wherein the actual ink color value is measured optically.

12. The method of claim 9 wherein the sensitivity variable is dependent upon a weighted modifier multiplied by the difference between the desired ink color correction amount and the actual ink color correction amount.

13. The method of claim 12 wherein the weighted modifier is based upon the difference between the actual ink color value at time (t) and the target ink color value.

14. The method of claim 9 wherein the controller is a PID controller.

15. The method of claim 14 wherein the sensitivity variable is multiplied by the integral, proportional and differential nominal gain parameters of the PID controller to obtain the new position of the ink control device.

16. The method of claim 9 wherein a new value of the sensitivity variable is calculated only after a change in the position of the ink control device.

17. The method of claim 9 wherein the sensitivity variable at time (t+1) is further based upon the sensitivity variable at time (t).

18. The method of claim 9 wherein the sensitivity variable at time (t+1) is calculated as the sensitivity variable at time (t) plus the sensitivity variable at time (t) multiplied by the difference between the desired ink color correction amount and the actual ink color correction amount at time (t+1).

19. The method of claim 9 wherein the sensitivity variable at time (t+1) is calculated as the sensitivity variable at time (t) plus the sensitivity variable at time (t) multiplied by a weighted modifier multiplied by the difference between the desired ink color correction amount and the actual ink color correction amount at time (t+1).

20. The method of claim 19 wherein the weighted modifier is based upon the ink color error at time (t).

* * * * *